US008534755B2

(12) United States Patent
Nickerson

(10) Patent No.: US 8,534,755 B2
(45) Date of Patent: Sep. 17, 2013

(54) DETACHABLE CHAIR CUSHION AND BACKPACK ASSEMBLY

(76) Inventor: Michael Nickerson, Torrington, CT (US)

( * ) Notice: Subject to any disclaimer, the term of this patent is extended or adjusted under 35 U.S.C. 154(b) by 166 days.

(21) Appl. No.: 12/627,139

(22) Filed: Nov. 30, 2009

(65) Prior Publication Data

US 2011/0127815 A1 Jun. 2, 2011

(51) Int. Cl.
*A47C 31/00* (2006.01)
*A47C 7/62* (2006.01)

(52) U.S. Cl.
USPC ..... 297/219.1; 297/228.13; 297/217.1

(58) Field of Classification Search
USPC ..... 297/219.1, 228.13, 217.1
See application file for complete search history.

(56) References Cited

U.S. PATENT DOCUMENTS 4,925,064 A 5/1990 Comora
4,925,241 A * 5/1990 Geraci ..... 297/229
5,573,155 A * 11/1996 Sadler ..... 224/155
5,573,166 A * 11/1996 Leja ..... 224/630
5,819,999 A 10/1998 Tennant
5,988,465 A * 11/1999 Vitale et al. ..... 224/155
D485,432 S * 1/2004 Desrochers ..... D3/216
6,830,293 B2 * 12/2004 Vanderminden ..... 297/219.1
7,694,788 B2 * 4/2010 Hann ..... 190/1
2003/0097713 A1 * 5/2003 Kinchen et al. ..... 5/652
2004/0155506 A1 * 8/2004 Gentry ..... 297/380

* cited by examiner

*Primary Examiner* — Sarah B McPartlin
(74) *Attorney, Agent, or Firm* — Jon Fallon, Esq.

(57) ABSTRACT

Embodiments of the present invention broadly relate to a chair cushion adaptable for transport on a backpack and adaptable to industry-standard seating devices for safety and comfort. In one embodiment of the present invention, a portable chair cushion apparatus comprises a back support portion, having an outer casing surrounding a cushion material, and back support attachment means protruding from a rear surface thereof, a seat portion, having an outer casing surrounding a cushion material, and a backpack connection means protruding from a bottom surface thereof, and a connection strap attached to the rear surface of the back support portion on a first end, and attached to the bottom surface of a seat portion on a second end.

16 Claims, 6 Drawing Sheets

DETACHABLE CHAIR CUSHION AND BACKPACK ASSEMBLY

BACKGROUND OF THE INVENTION

1. Field of the Invention

Embodiments of the present invention generally relate to a detachable chair cushion and backpack assembly. More specifically, embodiments of the present invention relate to a chair cushion adaptable for transport on a backpack and adaptable to industry-standard seating devices for safety and comfort.

2. Description of the Related Art

In many convention halls, classrooms, gymnasiums, or similar venues, it is very common to utilize industry-standard seating such as folding chairs, benches, etc. to accommodate any number of persons in adjustable seating configurations within the venue. While the industry-standard seating is often quite hard, it is generally inexpensive and allows for event versatility, making it an optimal choice for many venue owners and operators. However, individuals who have to attend an event in any such venues may find the seating to be uncomfortable, and possibly even dangerous to a person's health (i.e., spine alignment, posture, etc.).

Attempts have been made to provide a seat cushion device that individuals may carry with them to place on the surface of the seat, and provide increased comfort when seated. However, such known seat cushions often slide during use, causing a person a different type of discomfort. Similarly, such seat cushions must often be carried around by hand, which is not always convenient, for example, if an individual is attending a lecture in a city's convention hall, such individuals may not be able to return home or to a hotel room until hours before and/or after the lecture.

Thus, there is a need for a chair cushion adaptable for transport on a backpack and adaptable to industry-standard seating devices for safety and comfort.

SUMMARY OF THE INVENTION

Embodiments of the present invention broadly relate to a chair cushion adaptable for transport on a backpack and adaptable to industry-standard seating devices for safety and comfort. In one embodiment of the present invention, a portable chair cushion apparatus comprises a back support portion, having an outer casing surrounding a cushion material, and back support attachment means protruding from a rear surface thereof, a seat portion, having an outer casing surrounding a cushion material, and a backpack connection means protruding from a bottom surface thereof, and a connection strap attached to the rear surface of the back support portion on a first end, and attached to the bottom surface of a seat portion on a second end.

In another embodiment of the present invention, a detachable chair cushion and backpack assembly comprises a portable chair cushion comprising a back support portion, having an outer casing surrounding a cushion material, and back support attachment means protruding from a rear surface thereof, a seat portion, having an outer casing surrounding a cushion material, and a backpack connection means protruding from a bottom surface thereof, and a connection strap attached to the rear surface of the back support portion on a first end, and attached to the bottom surface of a seat portion on a second end; and a backpack comprising an accessible voluminous storage portion defined by at least a woven or non-woven fabric, having a resealable access seam across a portion thereof, at least a first shoulder strap extending from a location proximate the top of the accessible voluminous storage portion to a location proximate a bottom of the accessible voluminous storage portion, and a portable chair cushion connection means extending from an outer surface of the voluminous storage portion.

In yet another embodiment, a method of increasing an individual's comfort when seated, comprises providing an individual with a detachable chair cushion and backpack assembly comprising a portable chair cushion comprising a back support portion, having an outer casing surrounding a cushion material, and back support attachment means protruding from a rear surface thereof; a seat portion, having an outer casing surrounding a cushion material, and a backpack connection means protruding from a bottom surface thereof; and a connection strap attached to the rear surface of the back support portion on a first end, and attached to the bottom surface of a seat portion on a second end; and a backpack comprising an accessible voluminous storage portion defined by at least a woven or non-woven fabric, having a resealable access seam across a portion thereof; at least a first shoulder strap extending from a location proximate the top of the accessible voluminous storage portion to a location proximate a bottom of the accessible voluminous storage portion; and a portable chair cushion connection means extending from an outer surface of the voluminous storage portion; connecting the portable chair cushion to the backpack by engaging the backpack connection means with the chair cushion connection means; transporting the detachable chair cushion and backpack assembly to a desired location having at least an industry-standard seating device; removing the portable chair cushion from the detachable chair cushion and backpack assembly; and affixing the portable chair cushion to the industry-standard seating device utilizing the back support attachment means.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
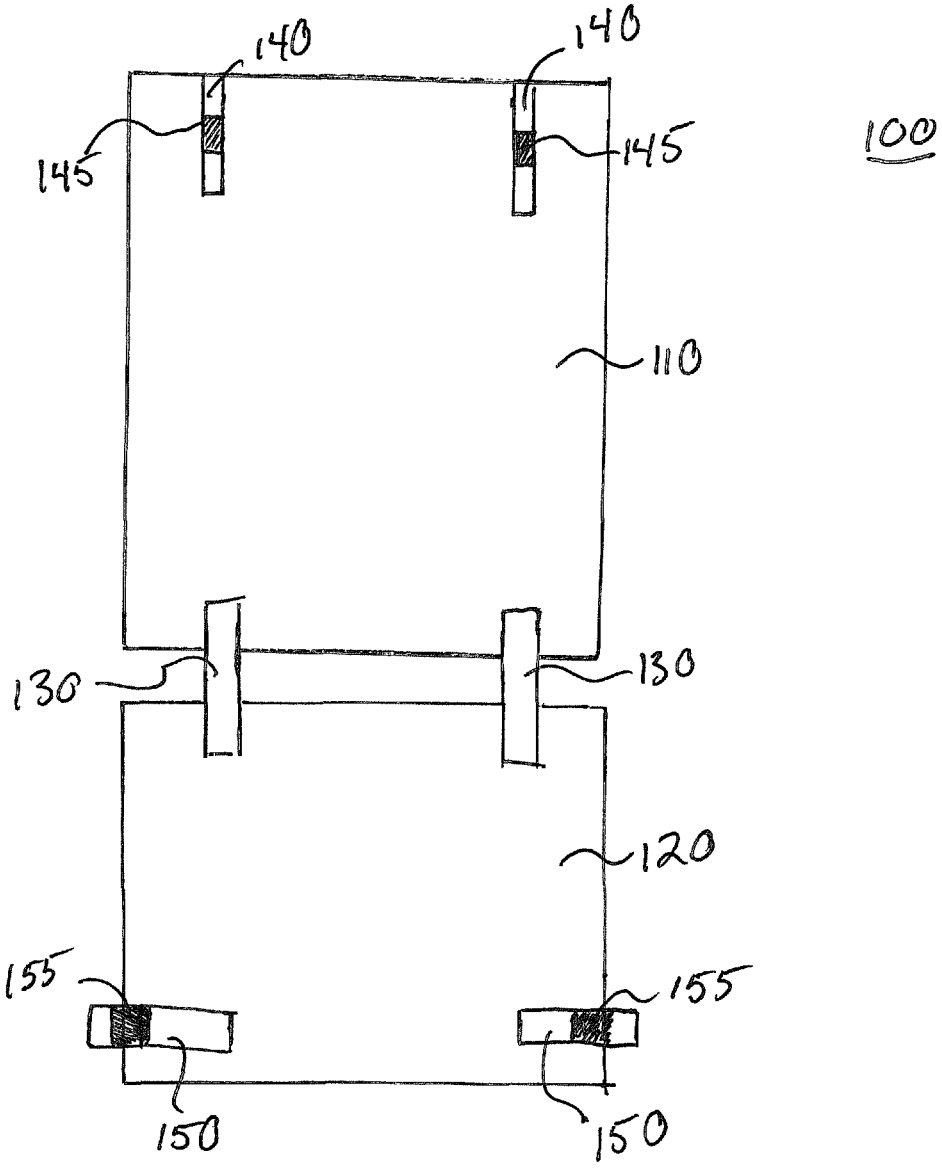
FIG. 1 depicts a bottom view of an extended cushion of a detachable chair cushion and backpack assembly in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention generally relate to a detachable chair cushion and backpack assembly. More specifically, embodiments of the present invention relate to a chair cushion adaptable for transport on a backpack and adaptable to industry-standard seating devices in numerous public locations for safety and comfort.

FIG. 1 depicts a bottom view of an extended cushion of a detachable chair cushion and backpack assembly in accordance with one embodiment of the present invention. A cushion 100 generally comprises a back support portion 110 and a seat portion 120, connected by at least one connection strap 130. Although two connection straps 130 are shown, any number of connection straps 130 may be provided to connect the back support portion 110 to the seat portion 120, including a single connection strap 130 extending the entire width of the cushion 100.

In one embodiment, the back support portion 110 generally comprises a plurality of straps 140 having buckles 145 positioned thereon. The strap and buckle assembly allows for the back support portion to attach to a back support of an industry standard seating device (e.g., a folding chair, a bench, etc.) (not shown). Embodiments of the present invention further contemplate a variety of other attachment means for positioning the back support portion 110 against a seating device, and are discussed in detail below.

In another embodiment, the seat portion 120 of the cushion 100 generally comprises at least one strap 150 having either one of a male or female end of a buckle 155 affixed thereon. Generally, the end of the buckle 155 will connect with an opposing buckle end on a backpack (not shown) or other device to allow for ease of transport of the cushion 100. Embodiments of the present invention further contemplate a variety of other attachment means for attaching the cushion to a transport medium, such as a backpack, and are discussed in detail below.

The size of the cushion 100 may generally be dependent upon the size of the user, and may be manufactured to any size, scale or shape suitable for embodiments of the present invention. In one embodiment, the cushion 100 may be between about 18 inches to about 54 inches in total length, as would be measured in an extended position, as shown in FIG. 1. In another embodiment, the back support portion 110 is between about 10 inches to about 30 inches in length, and between about 10 inches to about 24 inches in width. In yet another embodiment, the seat portion 120 is between about 8 inches to about 24 inches in length, and between about 10 inches to about 24 inches in width. In further embodiments, the height of both the back support portion 110 and the seat portion 120 may be between about 0.25 inches to about 3 inches.

In one specific exemplary embodiment, the back support portion 110 comprises dimensions of approximately 17 inches in length, 14 inches in width and about an inch in height, and the seat portion comprises dimensions of approximately 12 inches in length, 14 inches in width and about an inch in height. In such an exemplary embodiment, each of the straps provided therein are approximately one inch in width and may have varying lengths depending on their applicability.

Figure 2:
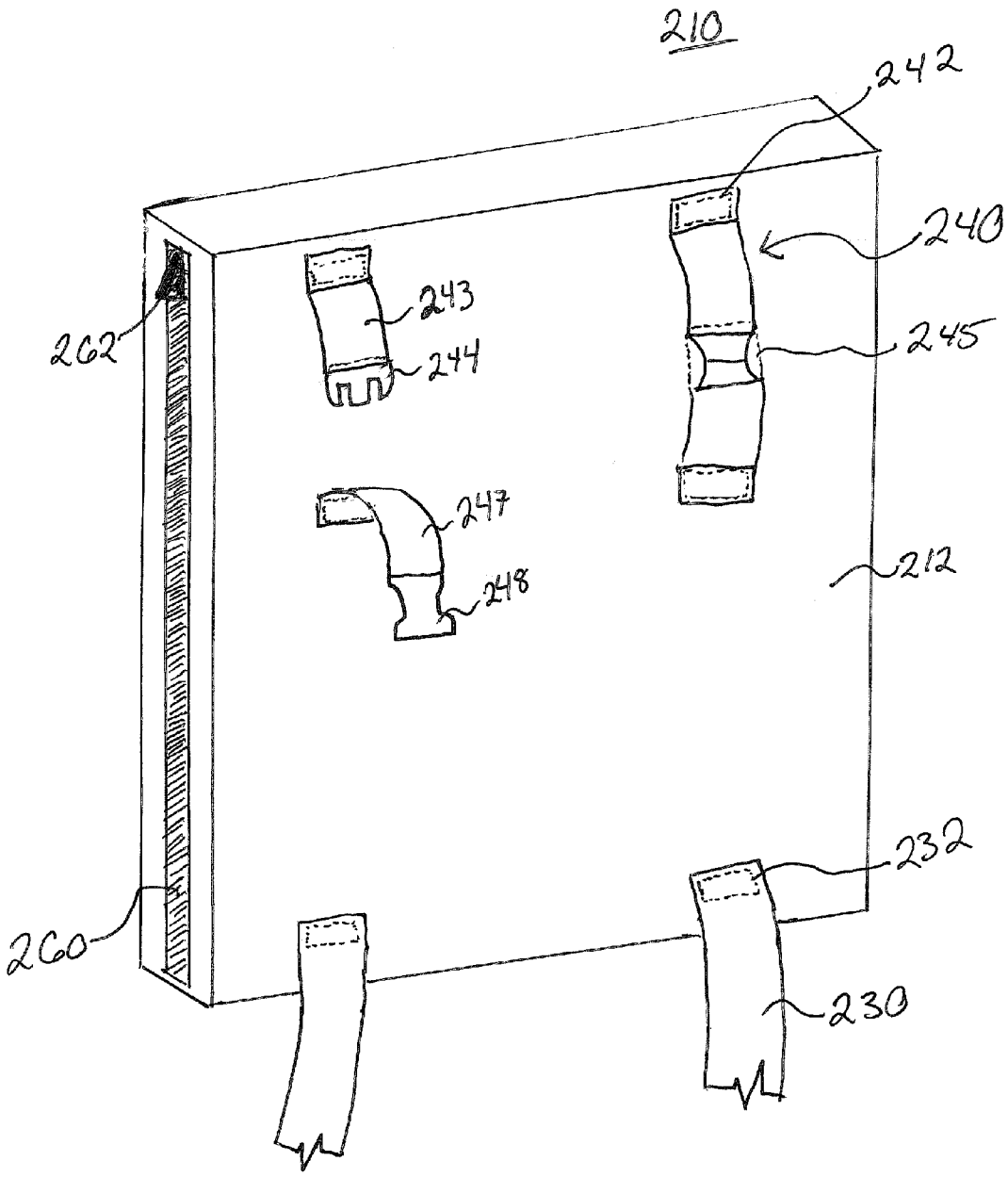
FIG. 2 depicts a perspective view of a back support of a cushion in accordance with one embodiment of the present invention.

FIG. 2 depicts a perspective view of a back support of a cushion in accordance with one embodiment of the present invention. The back support portion 210 generally comprises an outer casing 212 surrounding a cushion material (not shown). The outer casing 212 may comprise any woven or non-woven fabric, which may include any natural or synthetic fibers or materials. In one embodiment, the outer casing 212 comprises any one of a standard fabric (e.g., cotton, canvas, denim, or the like), a decorative fabric (e.g., satin, sateen, velvet, felt, silk, or the like), a waterproof or water resistant synthetic fabric (e.g., rubber, polyvinyl chloride, polyurethane, silicone elastomer, wax-coated fibers, or the like), or the like. In many embodiments, it may be desirable to provide an outer casing 212 that is machine or hand washable without being damaged.

The cushion may comprise any cushion material suitable for embodiments of the present invention. In one embodiment, the cushion may comprise any of an open- or closed-cell foam, a natural or synthetic rubber, a natural or synthetic fiber, an air-filled polymer encasement (i.e., a polymer balloon), or the like. In certain embodiments, the cushion may comprise a heating element. The heating element may comprise any known heating elements for seating devices, including heating coils, hot water storage compartments, chemically-induced heating means (e.g., heating packs using exothermic oxidization of iron or exothermic crystallization of super-cooled materials like sodium acetate), or the like.

As discussed above, the back support portion 210 is generally connected to at least one connection strap 230. In many embodiments, the connection strap 230 is merely stitched on a first end 232 to the outer casing 212 of the back support portion 210. In alternative embodiments, the connection strap 230 may be removably attached to the back support portion 210, for example with mechanical snaps, buttons, hook and loop fasteners (e.g., Velcro), or the like. In another embodiment, the connection strap 230 may be formed integral with the outer casing 212, during the manufacturing of the outer casing 212. In such an embodiment, the outer casing 212 of the back support portion 210 and the outer casing (not shown) of the seat portion (not shown) may likely be manufactured as a single unit.

The back support portion 210 further comprises a back support attachment means 240, for attaching the back support portion 210 to a back support of an industry standard seating device (e.g., a folding chair, a bench, etc.) (not shown). The back support attachment means 240 may comprise any mechanical attachment device suitable for embodiments of the present invention. Exemplary back support attachment means include: a strap and buckle assembly, a suction cup, a hook and loop fastener assembly, an adhesive (e.g., a removable adhesive leaving little to no residue on a surface of the back support of the industry standard seating device), a tie strap (e.g., a plurality of ropes, straps, etc.), a bracket assembly (e.g., a rigid mechanical member for extending from the back support portion 210 over a back support of the industry standard seating device, using a clamp or similar resistive type retaining mechanism), a slip cover or pocket (e.g., an extension of cloth forming a pocket or cover on the back of the back support portion 210 for covering or surrounding the back support of the industry standard seating device, particularly a folder chair, or other seating device having an individual back support)

As shown in FIG. 2, in one exemplary embodiment, the back support attachment means 240 comprise a strap and buckle assembly 245. The strap and buckle assembly 245 may generally be stitched to the outer casing 212 of the back support portion 210, for example, on each of its ends, as shown with a first end 242. In alternative embodiments, the back support attachment means 240 may be removably attached to the back support portion 210, for example with mechanical snaps, buttons, hook and loop fasteners (e.g., Velcro), or the like. By providing a removable attachment, various types of back support attachment means 240, as described above, may be interchangeable depending on the nature of the industry-standard seating device.

A strap and buckle assembly 245 generally comprises a first strap 243 connected to a male end of a snap buckle 244, and an opposing second strap 247 connected to a female end of the snap buckle 248. As is generally understood with snap buckles, when the male end 244 is inserted into the female end 248, the resilience of each of the protrusions of the male end 244 force certain projections into apertures in the female end 248, allowing the buckle to remain in a locked position. In order to unlock the buckle, a user may squeeze the projections of the male end 244 and pull the apparatus apart. While a snap buckle is shown, any type of buckle, including a threaded buckle or a tang buckle (e.g., a traditional belt buckle) is suitable for embodiments of the present invention.

In some embodiments, it may be desirable to provide a resealable access seam 260 on one end of the outer casing 212 to allow access to the cushion material therein. In many embodiments, the reasealable access seam 260 comprises at least one of a zipper, a plurality of mechanical snaps, a plurality of buttons, a hook and loop fastener assembly, or the like. As shown, a zipper 262 is provided as a means to open and close the resealable access seam 260, in which instance, a plurality of zipper teeth would be provided along the resealable access seam 260.

Figure 3:
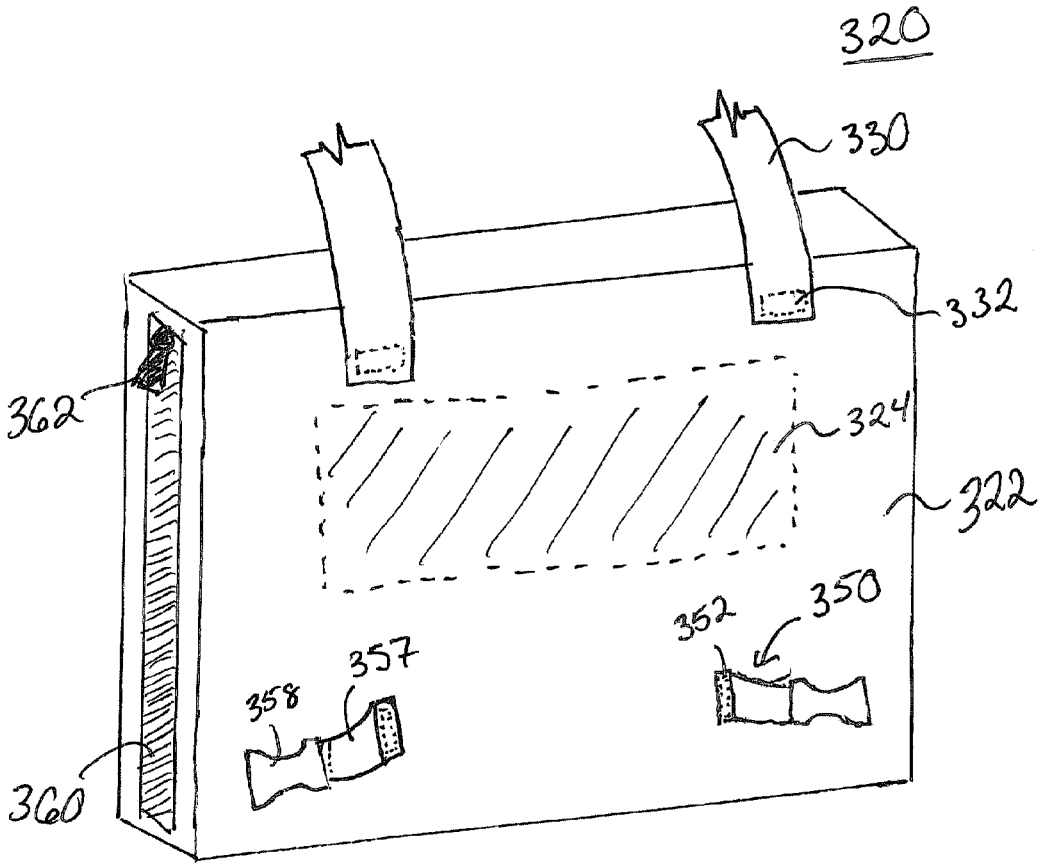
FIG. 3 depicts a perspective view of a seat portion of a cushion in accordance with one embodiment of the present invention.

FIG. 3 depicts a perspective view of a seat portion of a cushion in accordance with one embodiment of the present invention. The seat portion 320 generally comprises an outer casing 322 surrounding a cushion material (not shown). The outer casing 322 may be substantially similar to the outer casing of the back support portion, and may comprise any woven or non-woven fabric, which may include any natural or synthetic fibers or materials. In one embodiment, the outer casing 322 comprises any one of a standard fabric, a decorative fabric, a waterproof or water resistant synthetic fabric, or the like. In many embodiments, it may be desirable to provide an outer casing 322 that is machine or hand washable without being damaged.

In certain embodiments, at least a portion of a bottom surface of the outer casing 322 of the seat portion 320 may be provided with a non-skid material, for example, rubber or polymerized fabrics, having a high coefficient of friction therein. As an alternative to replacing the material of the outer casing 322, a non-skid retention mechanism, such as a suction cup, a rubber pad, or the like, may be provided thereon.

Also similar to the back support portion, the cushion material may comprise any cushion material suitable for embodiments of the present invention. In one embodiment, the cushion may comprise any of an open- or closed-cell foam, a natural or synthetic rubber, a natural or synthetic fiber, an air-filled polymer encasement, or the like. In certain embodiments, the cushion may comprise a heating element. The heating element may comprise any known heating elements for seating devices, including heating coils, hot water storage compartments, chemically-induced heating means, or the like.

The seat portion 320 is generally connected to at least one connection strap 330. In many embodiments, the connection strap 330 is merely stitched on a first end 332 to the outer casing 322 of the seat portion 320. In alternative embodiments, the connection strap 330 may be removably attached to the seat portion 320. In another embodiment, the connection strap 330 may be formed integral with the outer casing 322, during the manufacturing of the outer casing 322. In such an embodiment, the outer casing 322 of the seat portion 320 and the outer casing (not shown) of the back support portion (not shown) may likely be manufactured as a single unit.

In some embodiments, it may be desirable to provide a resealable access seam 360 on one end of the outer casing 322 to allow access to the cushion material therein. In many embodiments, the reasealable access seam 360 comprises at least one of a zipper, a plurality of mechanical snaps, a plurality of buttons, a hook and loop fastener assembly, or the like. As shown, a zipper 362 is provided as a means to open and close the resealable access seam 360, in which instance, a plurality of zipper teeth would be provided along the resealable access seam 360.

The seat portion 320 generally comprises a backpack connection means 350 extending from the bottom surface thereof. In many embodiments, the backpack connection means 350 comprises any mechanical attachment device for connecting the portable seat cushion to a backpack, or similar means of transport. Exemplary backpack connection means 350 comprise at least one of a strap and buckle assembly, a hook and loop fastener assembly, a tie strap or the like. Although two backpack connection means 350 are shown, any number of backpack connection means 350 is contemplated by various embodiments of the present invention.

As shown in FIG. 3, the backpack connection means 350 comprises one end of a strap and buckle assembly. The strap 357 may be affixed to the outer casing 322 on a first end 352, and connected to an end (either male or female) of a buckle 358. The opposing end of the buckle is generally provided on a backpack (not shown) and will be discussed in more detail below. While a snap buckle is shown, any type of buckle, including a threaded buckle or a tang buckle (e.g., a traditional belt buckle) is suitable for embodiments of the present invention.

Figure 4:
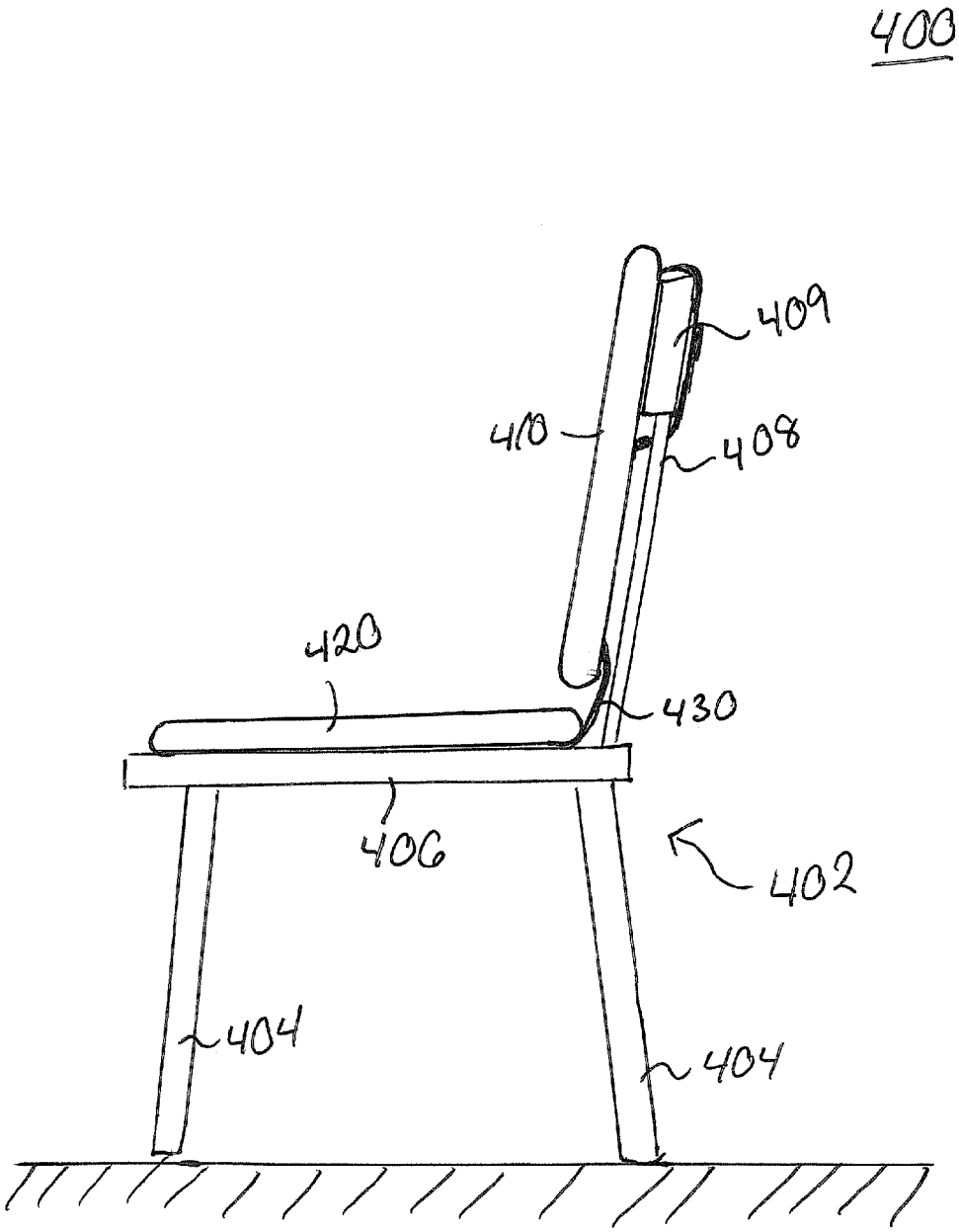
FIG. 4 depicts a side view of a cushion in use on a chair in accordance with one embodiment of the present invention.

FIG. 4 depicts a side view of a cushion in use on a chair in accordance with one embodiment of the present invention. As shown in the Figure, an industry-standard seating device 402 (e.g., a folding chair) may generally comprise a plurality of legs 404, a seat 406, a back support 409, and a frame for the back support 408. When the cushion is properly positioned on the seating device 402, the back support portion 410 is positioned against the back support 408, and retained in place using the back support attachment means. The seat portion 420, which is connected to the back support portion 410 using a connection strap 430, generally lays flat against the top surface of the seat 406. In certain embodiments, where a non-skid material is provided on a bottom surface of the seat portion 420, the seat portion 420 would remain substantially in place, even when a user adjusted his or her body position, due to the high coefficient of friction on the seat surface.

Figure 5:
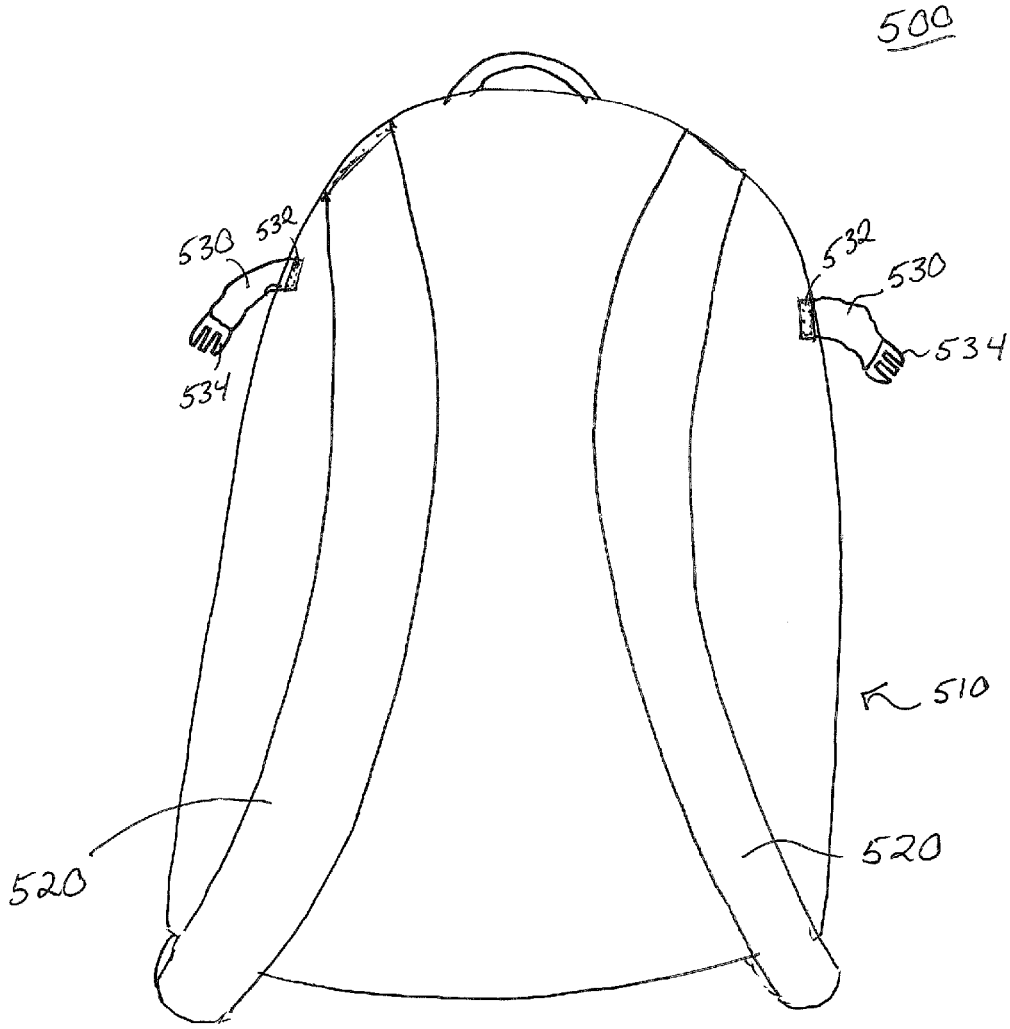
FIG. 5 depicts a rear view of a backpack in accordance with one embodiment of the present invention.

FIG. 5 depicts a rear view of a backpack in accordance with one embodiment of the present invention. A backpack 500 generally comprises voluminous storage portion 510 having a resealable access seam (not shown) across a portion thereof. The voluminous storage portion 510 is generally defined by a pattern of stitched woven or non-woven fabric, creating a substantially defined volume. The woven or non-woven fabric may comprise any type of fabric suitable for embodiments of the present invention, and may include any of the materials described hereinabove.

The backpack 500 generally comprises at least a shoulder strap 520 extending from a location proximate the top of the accessible voluminous storage portion to a location proximate a bottom of the accessible voluminous storage portion. As understood by embodiments of the present invention, any number of shoulder straps 420 may be provided with the backpack to accommodate various stylistic and function purposes.

In accordance with one embodiment of the present invention, a backpack 500 may generally comprise at least one portable chair cushion connection means 530 extending from an outer surface of the voluminous storage portion 510. The portable chair cushion connection means 530 may comprise any type of mechanical attachment to receive the backpack connection means of a cushion, as described above. Generally, the nature of the portable chair cushion connection means 530 is dependent upon the type of backpack connection means, and in one embodiment, comprises at least one of a strap and buckle assembly, a hook and loop fastener assembly, a tie strap or the like.

As shown in FIG. 5, the portable chair cushion connection means 530 comprises one end of a strap and buckle assembly. The strap may be affixed to the outer casing voluminous storage portion 510 on a first end 532, and connected to an end (either male or female) of a buckle 534. The opposing end of the buckle is generally provided on a portable chair cushion (not shown) as discussed above. While a snap buckle is shown, any type of buckle, including a threaded buckle or a tang buckle (e.g., a traditional belt buckle) is suitable for embodiments of the present invention.

Although shown as a traditional backpack, embodiments of the present invention appreciate that other types of voluminous storage bags may be utilized. For example, a backpack may also include a satchel bag, suitcase, purse, briefcase, duffel bag, or the like. In one example, wherein a satchel bag is utilized, the bag may generally comprise the components as described above with FIG. 5; however, the shoulder strap may extend from a location proximate the top of the accessible voluminous storage portion on a first end to a location proximate the top of the accessible voluminous storage portion on a second end.

Figure 6:
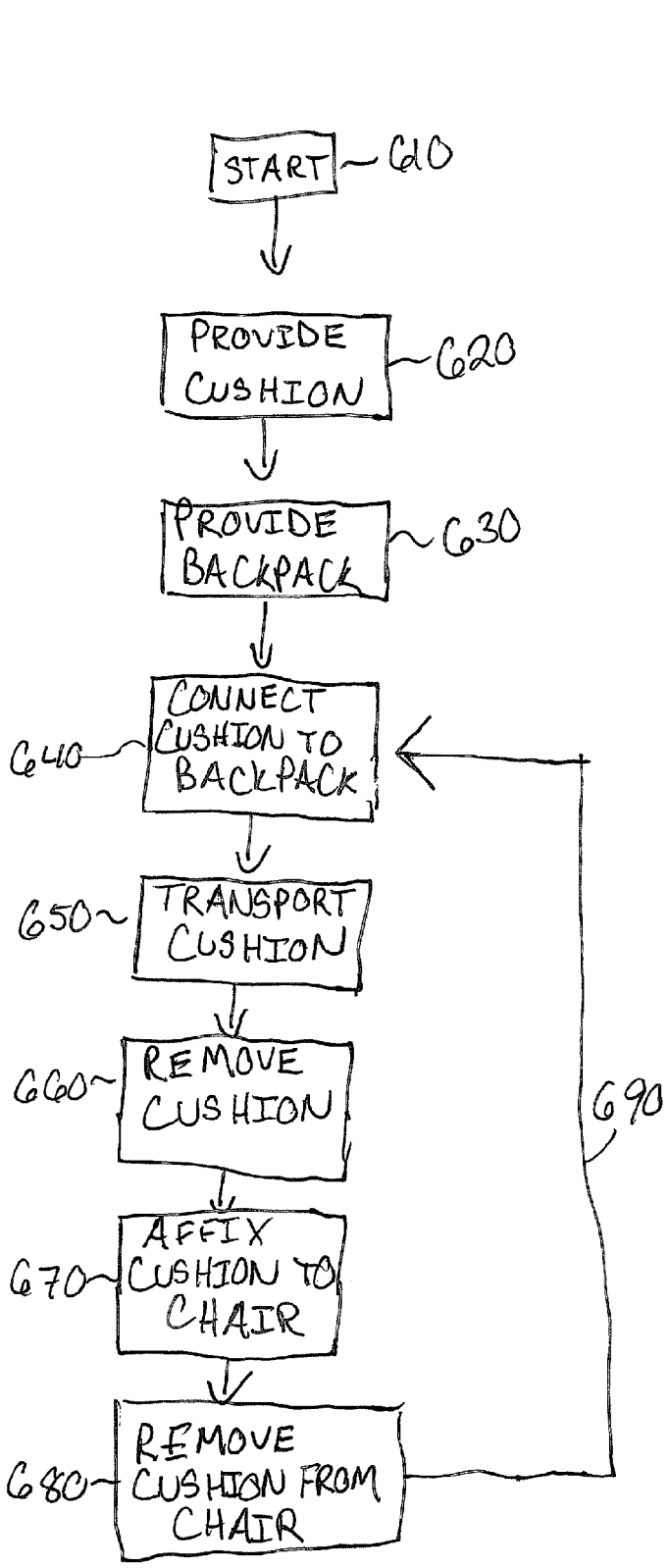
FIG. 6 depicts a flowchart of a method in accordance with one embodiment of the present invention.

FIG. 6 depicts a flowchart of a method of increasing an individual's comfort when seated, in accordance with one embodiment of the present invention. The method 600 generally begins at step 610. At step 620, a portable chair cushion is provided. In one embodiment, the portable chair cushion generally comprises a back support portion, having an outer casing surrounding a cushion material, and back support attachment means protruding from a rear surface thereof; a seat portion, having an outer casing surrounding a cushion material, and a backpack connection means protruding from a bottom surface thereof; and a connection strap attached to the rear surface of the back support portion on a first end, and attached to the bottom surface of a seat portion on a second end.

At step 630, a backpack is provided. In one embodiment, the backpack comprises an accessible voluminous storage portion defined by at least a woven or non-woven fabric, having a resealable access seam across a portion thereof; at least a first shoulder strap extending from a location proximate the top of the accessible voluminous storage portion to a location proximate a bottom of the accessible voluminous storage portion; and a portable chair cushion connection means extending from an outer surface of the voluminous storage portion.

At step 640, the portable chair cushion is connected to the backpack. In one exemplary embodiment, the portable chair cushion is connected to the backpack by engaging a backpack connection means, often comprising one end of a strap and buckle assembly, with a portable chair cushion connection means, often comprising a mating end of a strap and buckle assembly. Once engaged, regardless of the nature of the mechanical connection, the portable chair cushion is substantially and removably affixed to the backpack.

At step 650, the portable chair cushion may be transported to a location, for example, a venue having industry-standard seating devices (e.g., metal folding chairs). At step 660, the portable chair cushion may be removed from the backpack. In one embodiment, the portable chair cushion is removed from the backpack by pressing in the protrusion from the male end of buckle, and releasing it from the female end of the buckle assembly.

At step 670, the portable chair cushion may be affixed to the industry-standard seating device. In one embodiment, the seat portion of the portable chair cushion is positioned over a seat of the seating device, and the back support portion of the portable chair cushion is held against the back support of the seating device. The back support attachment means is then positioned around the back support of the seating device and locked into place.

At step 680, when the user wishes to leave the venue, change seats, or merely remove the portable chair cushion, the portable chair cushion may be removed from the seating device by disconnecting the back support attachment means from around the back support of the seating device. At step 690, the method 600 returns to step 640, at which time the portable chair cushion is connected to the backpack for further transport.

Various embodiments of the present invention may further comprise aesthetic designs or advertisements, as a means to generate revenue. For example, in one embodiment, at least one surface of the cushion may comprise a licensed trademark or logo (e.g., a professional sports team, a college, a cartoon character, or the like). Alternatively, embodiments of the present invention may be utilized for promotion, such as corporate sponsorships, charities, community events, or the like.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A portable chair cushion apparatus comprising:

a back support portion having an outer casing surrounding a cushion material and a back support attachment means protruding from a rear surface thereof, the back support attachment means comprising a pair of vertical strap assemblies, each vertical strap assembly consisting of:

a first strap fixed to the rear surface of the back support portion, the first strap attached to a first connector; and a second strap fixed to the rear surface of the back support portion, the second strap in vertical alignment with the first strap, the second strap attached to a second connector, wherein the first connector and the second connector are adapted to be mated to one another for affixing the back support portion to a back support of a chair, wherein the first connector and the second connector comprise one of a male portion and a female portion of a buckle assembly, wherein the first strap is adapted to be disposed over a top edge of the back support of the chair and the second strap is adapted to be disposed under a bottom edge of the back support of the chair when the first connector and the second connector are mated;

a seat portion having an outer casing surrounding a cushion material and a bag connection means protruding from a bottom surface thereof, the bag connection means consisting of a pair of horizontally aligned straps, each horizontally aligned strap having one end fixed directly to the bottom surface of the seat portion and having a connector on the free end thereof, the connector adapted to mate to a connector on a bag, wherein no portion of the horizontally aligned straps is attached to a side surface of the seat portion; and a connection strap attached to the rear surface of the back support portion on a first end, and attached to a bottom surface of the seat portion on a second end.

2. The portable chair cushion of claim 1, wherein the outer casing of the back support portion and the outer casing of the seat portion comprise at least one of a woven or non-woven fabric.

3. The portable chair cushion of claim 2, wherein the woven or non-woven fabric comprises at least one of natural or synthetic material.

4. The portable chair cushion of claim 3, wherein the natural or synthetic material comprises a waterproof or water-resistant polymer material.

5. The portable chair cushion of claim 1, wherein the cushion material of the back support portion and the cushion material of the seat portion comprise at least one of an open-cell foam, a natural or synthetic rubber, a natural or synthetic fiber, or an air-filled polymer encasement.

6. The portable chair cushion of claim 5, wherein one of the cushion material of the back support portion or the cushion material of the seat portion further comprises a heated portion therein.

7. The portable chair cushion of claim 1, wherein the outer casing of the back support portion and the outer casing of the seat portion each comprise a resealable access seam to allow access to the respective cushion materials therein.

8. The portable chair cushion of claim 7, wherein the resealable access seam comprises at least one of a zipper, a plurality of mechanical snaps, a plurality of buttons, or a hook and loop fastener assembly.

9. The portable chair cushion assembly of claim 1, wherein at least a portion of the bottom surface of the seat portion comprises a non-skid material.

10. The portable chair cushion assembly of claim 1, wherein a top surface of the seat portion comprises a pocket.

11. A detachable chair cushion and backpack assembly comprising:

a portable chair cushion comprising:

a back support portion having an outer casing surrounding a cushion material and a back support attachment means protruding from a rear surface thereof, the back support attachment means comprising a pair of vertical strap assemblies, each vertical strap assembly consisting of:

a first strap fixed to the rear surface of the back support portion, the first strap attached to a first connector; and a second strap fixed to the rear surface of the back support portion, the second strap in vertical alignment with the first strap, the second strap attached to a second connector, wherein the first connector and the second connector are adapted to be mated to one another for affixing the back support portion to a back support of a chair, wherein the first connector and the second connector comprise one of a male portion and a female portion of a buckle assembly, wherein the first strap is adapted to be disposed over a top edge of the back support of the chair and the second strap is adapted to be disposed under a bottom edge of the back support of the chair when the first connector and the second connector are mated;

a seat portion having an outer casing surrounding a cushion material and a backpack connection means protruding from a bottom surface thereof, the backpack connection means consisting of a pair of horizontally aligned straps, each horizontally aligned strap having one end fixed directly to the bottom surface of the seat portion and having a connector on the free end thereof, the connector adapted to mate to a connector on a backpack, wherein no portion of the horizontally aligned straps is attached to a side surface of the seat portion; and a connection strap attached to the rear surface of the back support portion on a first end, and attached to the bottom surface of the seat portion on a second end; and the backpack comprising:

an accessible voluminous storage portion defined by at least a woven or non-woven fabric, having a resealable access seam across a portion thereof;

at least a first shoulder strap extending from a location proximate the top of the accessible voluminous storage portion to a location proximate a bottom of the accessible voluminous storage portion; and a portable chair cushion connection means extending from an outer surface of the voluminous storage portion.

12. The detachable chair cushion and backpack assembly of claim 11, wherein the outer casing of the back support portion and the outer casing of the seat portion each comprise a resealable access seam to allow access to the respective cushion materials therein.

13. The detachable chair cushion and backpack assembly of claim 12, wherein the resealable access seam comprises at least one of a zipper, a plurality of mechanical snaps, a plurality of buttons, or a hook and loop fastener assembly.

14. The detachable chair cushion and backpack assembly of claim 11, wherein at least a portion of the bottom surface of the seat portion comprises a non-skid material.

15. A method of increasing an individual's comfort when seated, comprising:

providing an individual with a detachable chair cushion and backpack assembly comprising:

a portable chair cushion comprising a back support portion having an outer casing surrounding a cushion material and a back support attachment means protruding from a rear surface thereof, the back support attachment means comprising a pair of vertical strap assemblies, each vertical strap assembly consisting of two vertically aligned straps attached to the rear surface of the back support portion, each vertically aligned strap comprising one of a male and a female portion of a buckle assembly, wherein the vertical strap assembly is adapted to be disposed over a top edge and under a bottom edge of a back support of a chair when the male and female portions of the buckle assembly are attached; a seat portion having an outer casing surrounding a cushion material and a backpack connection means protruding from a bottom surface thereof, wherein no portion of the backpack connection means is attached to a side surface of the seat portion; and a connection strap attached to the rear surface of the back support portion on a first end, and attached to the bottom surface of a seat portion on a second end; and a backpack comprising an accessible voluminous storage portion defined by at least a woven or non-woven fabric, having a resealable access seam across a portion thereof; at least a first shoulder strap extending from a location proximate the top of the accessible voluminous storage portion to a location proximate a bottom of the accessible voluminous storage portion; and a portable chair cushion connection means extending from an outer surface of the voluminous storage portion;

connecting the portable chair cushion to the backpack by engaging the backpack connection means with the chair cushion connection means;

transporting the detachable chair cushion and backpack assembly to a desired location having at least an industry-standard seating device;

removing the portable chair cushion from the detachable chair cushion and backpack assembly; and affixing the portable chair cushion to the industry-standard seating device utilizing the back support attachment means.

16. The method of increasing an individual's comfort when seated of claim 15, wherein at least a portion of the bottom surface of the seat portion comprises a non-skid material.

* * * * *